US005775600A

United States Patent [19]

Wildeson et al.

[11] Patent Number: 5,775,600

[45] Date of Patent: Jul. 7, 1998

[54] METHOD AND FUEL INJECTOR ENABLING PRECISION SETTING OF VALVE LIFT

[76] Inventors: Ray Wildeson, 105 Sheild La., Yorktown, Va. 23692; David Wieczorek, 181 Revelle Dr., Newport News, Va. 23602; Gordon Wyant, 101 Northampton Dr., Hampton, Va. 23666; Christoph Hamann, Erlenweg 2, Kirchheim, Germany, 85551

[21] Appl. No.: 688,937

[22] Filed: Jul. 31, 1996

[51] Int. Cl.[6] ..... F02M 51/00

[52] U.S. Cl. ..... 239/585.4; 239/585.1

[58] Field of Search ..... 239/585.1–585.5, 239/5; 251/129.21

[56] References Cited

U.S. PATENT DOCUMENTS 5,307,991 5/1994 Hanson et al. ..... 239/585.5 X

FOREIGN PATENT DOCUMENTS 58-15758 1/1983 Japan ..... 239/585.5

*Primary Examiner*—Lesley D. Morris

*Attorney, Agent, or Firm*—Russel C. Wells

[57] ABSTRACT

A method and fuel injector for precision setting of valve lift, using a valve body shell (42) telescoped over the valve body (60), the shell (42) having a nonmagnetic extension welded to the valve body shell (42) and to the end of an inlet tube (16) providing a solenoid pole piece, with the valve body (60) and shell (42) adjusted to set the valve lift and thereafter welded together. Interference fit portions stabilize the adjusted position of the members preparatory to welding, and displaced material in a locking groove (102) creates a mechanical interlock between the valve body (60) and shell (42) to stabilize the members in their adjusted positions after welding so that the set lift is minimally affected by weld shrinkage. An external radial groove 18 allows radial bending as the weld cools to minimize axial shift of the parts and thus the effect on the set valve lift.

24 Claims, 7 Drawing Sheets

METHOD AND FUEL INJECTOR ENABLING PRECISION SETTING OF VALVE LIFT

FIELD OF THE INVENTION

This invention relates to fuel injectors for use in internal combustion engines and more particularly a manufacturing method and injector enabling precision setting of the lift of the valve element in a fuel injector to consistently and reliably provide the proper amount of fuel flow from the injector.

BACKGROUND OF THE INVENTION

The lift of a fuel injector is the distance the valve element travels in moving between the valve closed and open positions. The valve element assumes the closed position when a solenoid operator is deenergized to allow a closing spring to move the valve element onto a valve seat, and no fuel flows out of the injector tip. The valve element assumes an open position when the solenoid is energized to magnetically pull the valve element off the valve seat and against a fixed stop comprised of the end of an inlet tube to allow fuel to flow out of the injector for the period when the solenoid is energized.

The setting of valve lift has become critical as the design of engines for ever more stringent reduced emissions standards have evolved. These designs require closer control into each engine cylinder by the engine controls over the flow of fuel.

While setting the valve lift at a high value reduces the effect of lift variations on fuel flow, the performance of high lift valve designs are affected by greater resistance to the magnetic flux.

Low valve lifts are thus preferable, but lift height variations at low values cause much greater effects on flow, and hence the lift height must be set precisely with much tighter restrictions on tolerable lift height variations.

One method of setting lift requires matching the length of tightly toleranced machined parts in the subassemblies. The lift is set with a matched stop plate that the valve moves against when opened. Although this has been a successfully implemented method, the tight tolerances required, in addition to either matching groups of components or machining components to match, makes this a costly manner of obtaining tightly controlled valve lifts.

U.S. Pat. No. 4,610,080 issued to Hensley on Sep. 9, 1986 entitled "Method for Controlling Fuel Injector Lift" describes an alternative production method allowing the tolerances of the length of the subassemblies to be looser, by measuring the top subassembly length and the bottom subassembly length, and then deforming a lift spacer shim to match the desired lift, the subassemblies varying dimensions thereby accommodated. This method is less costly, yet due to the nature of the shim deformation, some production scrap results due to the lift not always equaling the desired lift setting.

Additionally, although the space requirement for the nominal shim is minimal, the tolerance stack ups in the sub assemblies must be accounted for in the deformation of the shim. This results in a large population spread for the outer and inner diameter of the deformed shim. Conventional injector envelopes have been able to accommodate the large variation in shim outer diameter and inner diameter, but the recent trend in down-sizing the injector outer diameter has made this lift setting process less desirable due to the space required. In addition the shim height also enters into squeeze height of sealing O-rings used with the injectors, and some subassembly combinations will result in O-ring squeeze outside of the recommended safe range, resulting in scrap.

More recent methods of lift setting have included welding the orifice disk to the seat, and then welding the orifice to the valve body. The orifice disk is then deformed to obtain the desired lift. This method does cost effectively allow the tolerance built into the subassemblies to be taken up in the final lift setting procedure, but the deformation of the orifice disk to accomplish lift can negatively impact the primary function of the orifice which is spray quality, particularly if considerable deformation is necessary.

Whatever method of lift setting is used, it must maintain squareness of the abutting armature and pole piece faces as out of square conditions of these surfaces will result in changing lift as the surfaces wear.

There has heretofore been practiced a method of setting valve opening positions by telescoped valve parts in the context of antilock brake control valves, but injector valve lift settings are much more precise and have not heretofore been set by such methodology.

It is an object of the present invention to provide a method of precisely setting the lift of the valve element in a fuel injector at relatively low cost which results in minimal lift variation in a given injector production run.

It is a further object of the present invention to provide such a reliable precision valve lift setting method for injectors which does not require shims, is compatible with compact injector envelopes, does not interfere with the injector spray pattern, and in which valve lift distance is maintained over extended service periods.

SUMMARY OF THE INVENTION

These and other objects of the present invention which will be apparent upon a reading of the following specification and claims are achieved by the use of a valve body shell member telescoped over the valve body. The valve body shell is fixed relative to the pole piece and the valve body has the valve seat fixedly attached to it so that the relative position of the valve body and valve body shell determine the valve lift. These members are telescoped together until a relative position corresponding to a desired lift is reached, this position detected by measuring equipment. The valve body and valve body shell members are thereafter welded together to permanently maintain this relative position.

The valve body shell has a nonmagnetic shell extension welded to an upper end thereof and to one end of an inlet tube functioning as the solenoid pole piece, on which the extension is piloted. The shell extension is hermetically welded to establish fluid containment when the lower end of the valve body shell is hermetically welded to the valve body. The valve body has a bore within which the armature carrying the valve element is slidable during injector operation as in conventional injectors. The armature is also slidable within a bore in the shell extension. The nonmagnetic valve body shell extension has an inner bore piloted over the pole piece. This rigid, welded assembly insures that the squareness of the end faces of the armature and inlet tube pole piece are maintained as telescoping of the valve body and valve body shell occurs to set the lift.

In practicing the method, two subassemblies of the injector are preassembled, a power group including the inlet tube and valve body shell, and a valve group including the valve body and valve seat.

When these subassembly components are initially assembled together, a lift greater than the final designed-for lift is established so that the lift can be adjusted by further advancing the valve body and valve body shell members together.

The valve body and valve body shell are dimensioned to have interfering dimension diameters which establishes a mechanical interlock when telescoped together to a final gaged position corresponding to the desired lift, so that the members will be fixed in the set position preparatory to welding.

A press fit of the upper portions of the parts also insures a good magnetic flux path for reliable solenoid operation by eliminating any possibility of clearance gaps. The tight fit maintains squareness of the armature motion with respect to the mating tube face, so as to avoid gradual changes in valve lift caused by an out-of-square condition.

The tight fit also assists in resisting post weld shifting due to weld shrinkage, as will be discussed below.

A closed loop control receiving signals from the measuring equipment can be used to control a servo motor to adapt the method to the production of fuel injectors.

The valve body and valve body shell are hermetically welded together to secure them in this final set position and to complete fluid containment without the use of seals.

In an improvement of this basic method, a localized region of interference fit between diameters on the valve body and valve body shell causes displacement of material of one of these members constructed of a more yieldable material into a groove on the other member of a harder material located adjacent the localized section as the members are telescoped to their final set position. In this improvement, the members may or may not have portions slightly press fitted together to aid in holding the members in a set position preparatory to welding, or alternatively the members may have a clearance fit combined with a mechanical interlock.

This effect produces a mechanical interlock between the valve body and valve body shell minimizing any relative shift caused by the shrinkage of the weld material tending to reduce the set lift of the valve.

As a further refinement, an intermediate weakening external groove may be provided so that the weld shrinkage acts to pull in a radial direction rather than to cause an axial shift of the parts, minimizing the shrinkage effects of cooling of the weld tending to shift the set lift of the valve.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
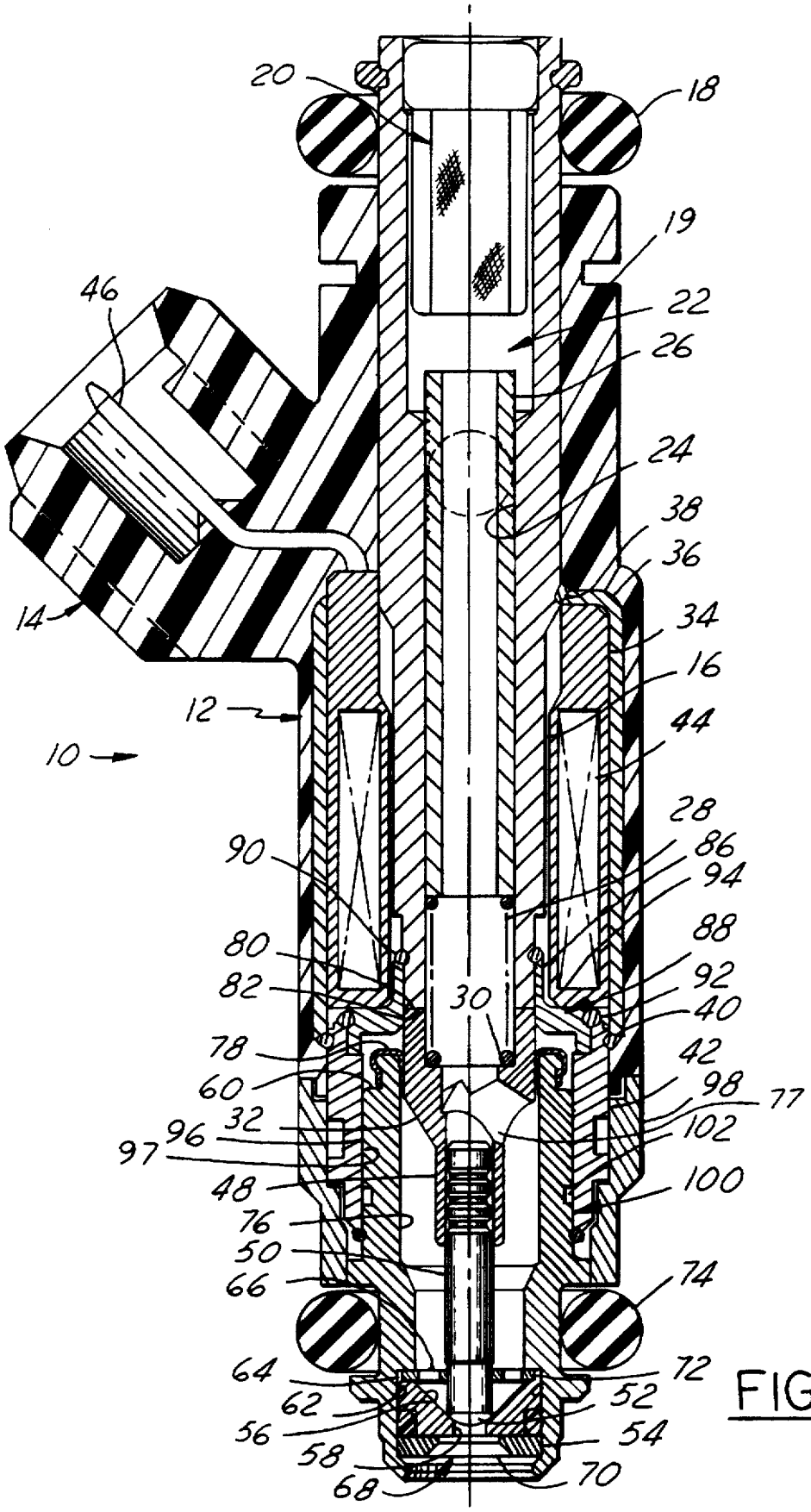
FIG. 1 is a lengthwise sectional view of a fuel injector according to the present invention.

Referring to the drawings and particularly FIG. 1, a completely assembled fuel injector 10 according to the present invention is shown, which comprises an elongated overmold outer housing 12 including an electrical connector portion 14 projecting from one side for receiving an electrical connector on a wiring harness (not shown). The general configuration of the fuel injector is shown in U.S. Patent Nos. 5,494,223; 5,494,224; and 5,494,225 all issued on Feb. 27, 1996.

An inlet tube 16 extends out of the upper end of the outer housing 12 and is adapted to be installed in a mating receptacle cup formed on a fuel rail (not shown). A suitable O-ring seal 18 is provided and a retention feature 19 provided to lock the injector 10 in position installed in the fuel rail.

A filter plug 20 is inserted in the upper end of a bore 22 in the inlet tube 16 receiving fuel under pressure from the fuel rail into which the injector 10 is installed.

An intermediate section 24 of the bore 22 receives an adjustment tube 26 shiftable lengthwise to adjust the force of a compression spring 28 lying beneath the lower or downstream end of the tube 26. The other end of the compression spring 28 is compressed against an end wall of a bore 30 in an armature 32. A tool not shown acts from the side to compress the inlet tube 16 onto the adjustment tube 26 when the proper spring force is set, the external ribs shown insuring a secure gripping action.

An annular operator solenoid coil assembly 34 is mounted within the outer housing 12, surrounding the lower end of the inlet tube 16. A coil housing 36 is welded at the weld 38 to the inlet tube 16 and is welded to a valve body shell 42 at the weld 40.

The solenoid coil 44 is energized by an electrical system providing for current flow via contacts 46.

The armature 32 has a reduced diameter tubular end 48 with the upper end of an elongated needle shaped valve element 50 crimped therein to be attached thereto.

The lower, free end of the valve element 50 is formed with a rounded tip 52 urged into engagement with a conical surface 54 of a valve seat 56 by the spring 20.

The valve seat 56 has an aligned outlet bore 58 so that when the valve tip 52 is lifted off the surface 54, fuel under pressure can flow to spray out of the outlet end of the injector 10 and fuel flow is shut off when the valve tip 52 is seated on the valve seat 56.

The valve seat 56 is fixed to the lower end of a generally tubular valve body 60 by being received in a bore section 62 between stacked guide disc 64 and a filter screen 66 on one end, and an orifice disc 68 and backup washer 70 on the other end of the valve seat. The stacked elements all held in abutment against a shoulder or step 72 in the valve body by a crimped end of the valve body 60 at the outlet end.

The outlet end of the fuel injector 10 is adapted to be received in a pocket of an intake manifold or cylinder head (not shown) and sealed therein by a suitable O-ring seal 74.

The valve body 60 has a main bore section 76 within which the armature 32 and valve element 50 are disposed. Fuel enters the main bore through a cross passage 77 in the armature 48.

The lower end of the valve element 50 is slidably guided in a central bore in the guide disc 64, while the upper end of the armature 32 is slidably guided in a formed metal guide eyelet 78 received in the upper end of valve body main bore section 76. The guide bore of the eyelet 78 can be precisely formed with a tool, after the eyelet 78 is crimped onto the upper end of the valve body main bore section 76.

The valve body shell member 42 is telescoped over the valve body 60 so as to be relatively movable during assembly.

The valve lift or the distance the valve element 50 can move upon energization of the solenoid coil 44 is defined by the clearance between the upstream end face 80 of the armature 32 and the downstream end face 82 of a solenoid pole piece, comprised of the lower end portion of the inlet tube 16.

This distance can be varied at assembly by fitting one member, i.e., the valve body shell 42, to be telescoped over another member, i.e., the outside diameter of the valve body 60, and shifting these members to adjust the valve lift. This adjustment capability results since the one member, the valve body shell 42, is fixed relative to the pole piece portion of the inlet tube 16 by a stepped diameter tubular nonmagnetic valve body shell extension 94, having an upper section 86 piloted over the pole piece portion of inlet tube 16. A lower section 88 of the valve body shell extension 94 is received in a counterbore in the upper end of the valve body shell 42.

Hermetic weld 90 fixes the upper section 86 to inlet tube 16 and hermetic weld 92 fixes the lower section 88 to the upper end of the valve body shell 42, both welds creating fluid containment of the fuel without O-ring seals. As noted above, the valve body shell 42 is fixed to the coil housing 36 by a nonhermetic weld 40.

The valve body shell extension 94 must not divert the magnetic field since the lines of flux should mainly pass through the armature 32 to cause the armature 32 to be drawn upwardly.

For this reason, the lower section extension 88 must be constructed of a nonmagnetic material such as Series 300 stainless steel, while the valve body shell 42 and valve body 60 should be of a more magnetic permeable materials such as 416 and 430 FR stainless steel since they must provide a path for the lines of magnetic flux formed when the solenoid 44 is energized. A laser welding process is used due to the need for hermetic welds with stainless steel material.

When the valve body 60 and valve body shell 42 are assembled together, diameter sections 96, 97 may be press fit together. This fit tends to assist in maintaining these members in a set position when shifted together to set a given lift both before and after completion of a welding step described below. The press fit also insures a good magnetic flux path as avoiding any clearance gaps and also helps to maintain squareness.

A plastic cover shell 98 is installed after welding.

Figure 7:
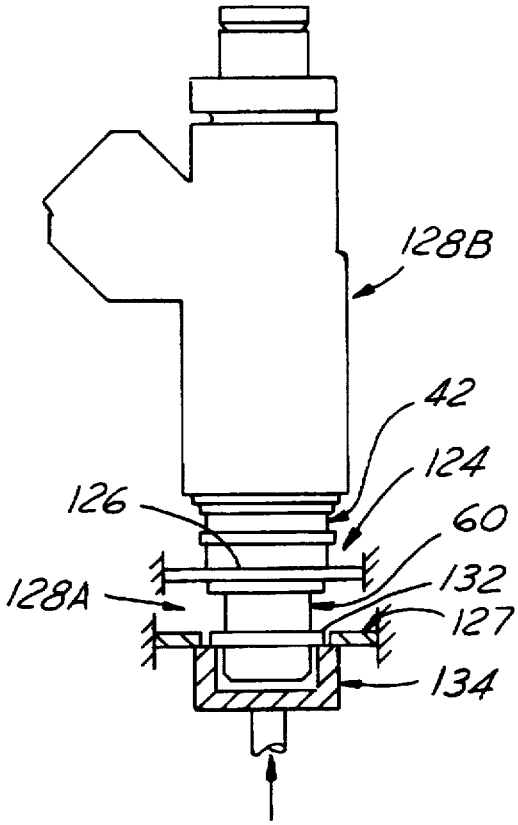
FIG. 7 is a diagrammatic representation of the initial assembly of the power group and valve group components.

During manufacture, the two subassemblies, the valve group 128A and the power group 128B, are completely assembled, except for the cover shell 98, as shown in FIG. 7.

The valve body 60 and the valve body shell 42 are included in respective subassemblies 128A, 128B but have portions which are interfit together in a particular way when these subassemblies are assembled together as a part of the process of setting the valve lift.

As noted above, the main interfit sections of the valve body shell 42 and the valve body 60 are press fit together by sizing the outer diameter 99 of the valve body 60 to be greater than the inner diameter 104 of the valve body shell 42. For example, the outer diameter 99 has a diameter of 9.275±0.025 mm and the inner diameter 104 has a diameter of 9.212±0.02 mm. An undersized entry section 95 on the valve body 60 at the upper end facilitates starting of the press fit assembly.

Figure 2:
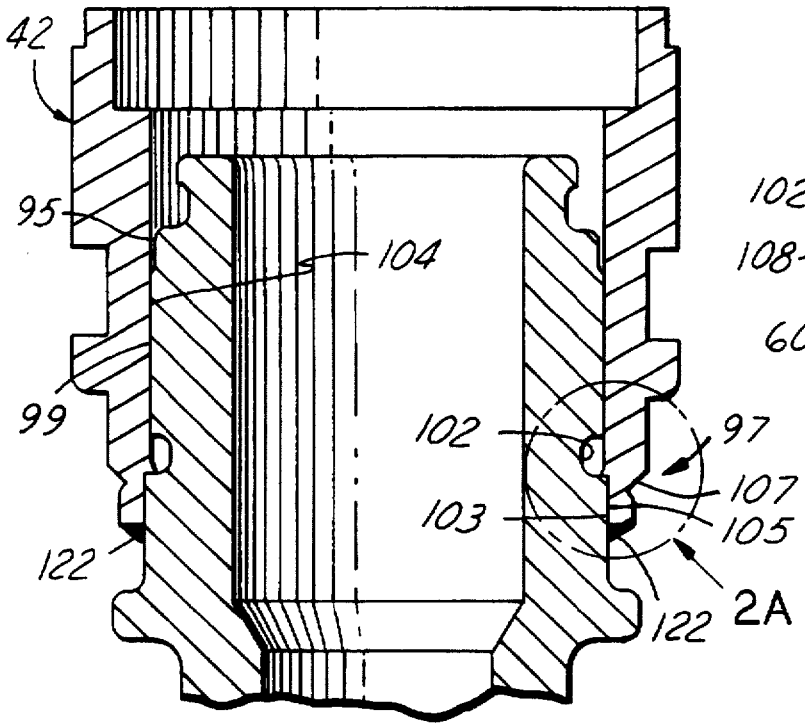
FIG. 2 is an enlarged sectional view of a portion of the injector valve shown in FIG. 1, showing details of the interference fit and clearance groove portions used to create a mechanical interlock stabilizing the lift after welding of the parts prior to setting of the lift.

FIG. 2 shows the relative position of the valve body 60 and valve body shell 42 when the valve group 128A and the power group 128B are assembled and welded. The inner diameter 104 of the valve body shell 42 is smaller than the adjoining outer diameter 105 of the valve body 60. For example, the diameter 105 may be 9.45±0.025 mm. The valve body shell 42 also has a smaller diameter welding skirt 97 having a diameter 103 overlying the diameter 105 with a slip fit therebetween.

A localized region 100 of a more substantial interference fit between the valve body 60 and valve body shell 42 is also provided with an adjacent locking groove 102, which together cause a mechanical interlock to be formed during the lift setting process as will be described below in further detail.

In this initial assembled condition, the lift is designed to be greater than the desired set lift.

Figure 2A:
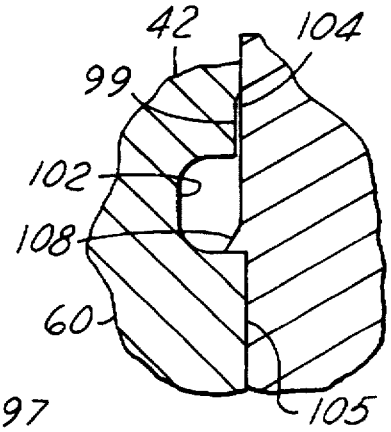
FIG. 2A is an enlarged fragmentary sectional view of a mechanical interlock formed by the interference fit and clearance groove portions upon shifting of the valve body and shell members.

The members 42, 60 are telescoped further together in the valve lift setting process to be described. The material of the valve body shell 42 (430 FR) is more yieldable than the material of the valve body 60 (416), so that a bulge 108 of material of the valve body shell 42 is displaced into the groove 102 as the lift is set (FIG. 2A). After a final lift is set, the end of the valve body shell 42 is then hermetically welded by a fillet weld 122 to the outside diameter of the valve body 60, with these perpendicular surfaces enabling the fillet weld.

The bulge 108 displaced into the locking groove 102 creates a mechanical interlock which has been found to stabilize the relative position of the valve body shell 42 and the valve body 60 and thus the lift after the fillet weld 122 has been made and the material thereafter cooled.

The inventors have discovered that there is a tendency for valve lift to be reduced after cooling of the weld, which tendency has been found to be minimized by this improvement. That is, as the welded material cools, shrinkage of this material draws the valve body 60 and the valve body shell 42 together to reduce the lift previously set.

The mechanical interlock, the bulge 108 and the locking groove 102, so created resists this tendency, allowing much greater consistency in the final resulting lift of large numbers of injectors manufactured using this process. In fact, this interlock may allow elimination of the press fitting of the valve body 60 and valve body shell 42; slip fitting these parts will greatly reduce the maximum forces required during lift setting.

The weld skirt 97 is formed with an outer V groove 107 at the transition with the larger diameter main portion. This V groove 107 further reduces the effect of weld cooling as it reduces the predominance of over movement as the weld cools by inducing radial bending.

Figure 3:
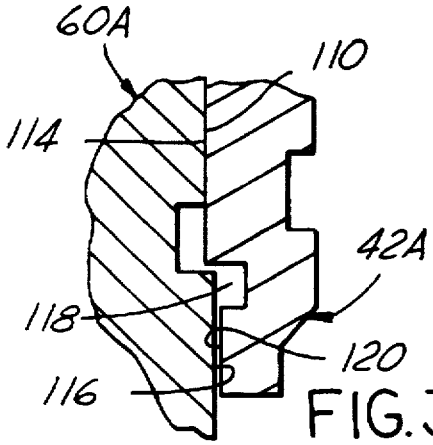
FIG. 3 is an enlarged fragmentary sectional view of an alternate form of the interfit portions of the valve body and valve body shell members.
Figure 3A:
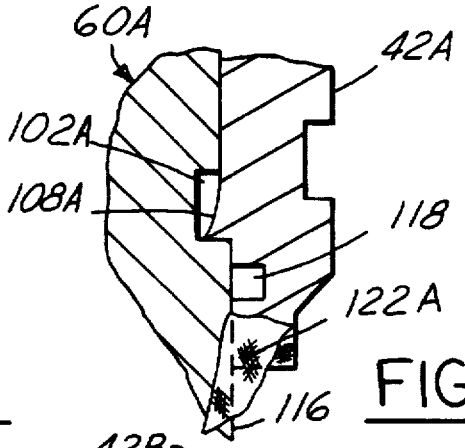
FIG. 3A is a view of the portions shown in FIG. 3 after lift setting and welding of the members.

FIGS. 3 and 3A show an alternate, less preferred geometry of the interfit portions of the valve body and valve body shell configuration. In this embodiment, the inner of the telescoped members, i.e., valve body 60A, has a diameter section 110 which may be a slight press or even a sliding fit within a diameter section of the outer member, the valve body shell 42A. The locking groove 102A is adjacent diameter 114 which has an interference fit with a second diameter section 116 of the valve body 60A.

In addition, a section thinning groove 118 is also provided in the outer valve body shell 42A between the lock groove 102A and the end of the valve body shell 42A whereat the weld is to be made. A clearance fit exists between the diameter 116 of the valve body 60A and a diameter 120 of the valve body shell 42A.

As noted above, the outer member, valve body shell 42A, is of a softer, more yieldable material such as 430 FR stainless steel, which has a Rockwell hardness on the "B" scale, while the inner member valve body 60A is of a harder, less yieldable material, such as 416 FR stainless steel, having a Rockwell hardness on the "C" scale.

Thus, as seen in FIG. 3A, a bulge 108A of the material of the valve body shell 42A is displaced into the locking groove 102A as these members are forced together during the lift setting process.

Once proper lift has been set as by the process described below, a laser weld bead 122A is applied between the end of the valve body shell 42A and the outside diameter 116 of the valve body 60A.

The groove 118 thins the thickness of the valve body shell 42A and thereby produces a weakening allowing the weld bead 122A to radially pull in the valve body shell 42A onto the diameter 116 of the valve body as shrinkage occurs. This expends part of the energy of the shrinkage so as to further reduce the effect of weld shrinkage on the valve lift.

Figure 4:
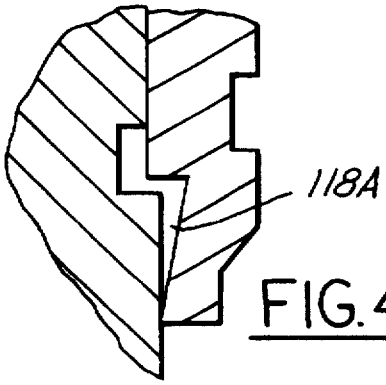
FIG. 4 is an enlarged fragmentary sectional view of an alternate form of the interfit portions of the valve body and shell members.

FIG. 4 shows a further variation in that the weakening groove 118A is tapered to enable easier access with a tool for machining purposes.

Figure 5:
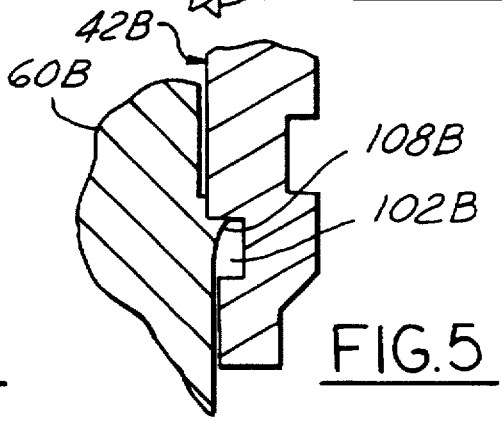
FIG. 5 is an enlarged fragmentary sectional view of an alternate form of the interfit portions of the valve body and shell members.

FIG. 5 shows a less preferred reversal of geometry where the locking groove 102B is in the outer valve body shell 42B rather than the valve body 60B. In this configuration, the valve body shell 42B is of harder material than the valve body 60B so that the bulge 108B is formed from the valve body material.

Figure 6:
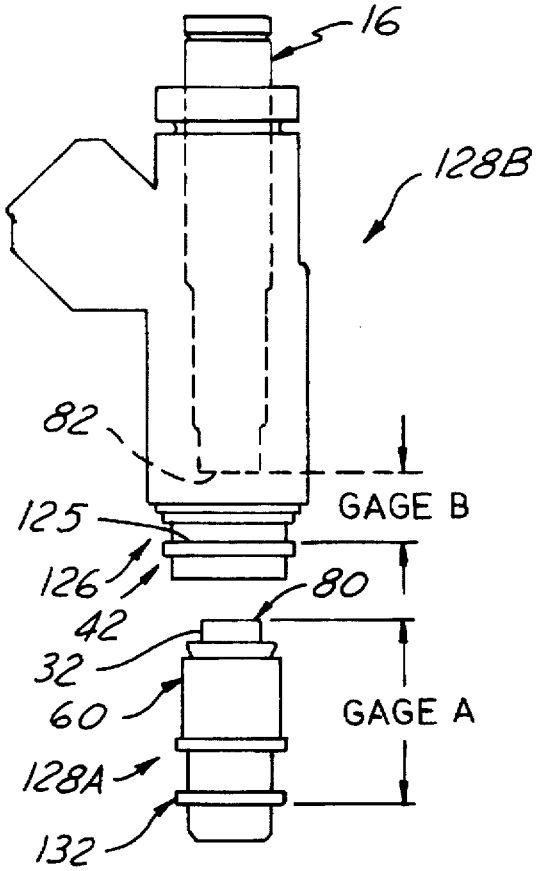
FIG. 6 is a simplified diagrammatic representation of the gaging of key dimensions of the preassembled power group and valve group subassemblies of the injectors.

FIG. 6 shows the two subassemblies which are separately preassembled, the valve group 128A, which includes the valve body 60 which has fixed to it the valve seat, guide, washer, etc. (not visible) and receives the armature 32, the end face protruding therefrom in FIG. 6.

The power group 128B includes the outer housing 36 enclosing the solenoid and the other internal components, the inlet tube 16 shown protruding at the top in FIG. 6, the valve body shell 42 at the bottom.

The dimension "A" is measured in the valve group which is the distance from the bottom of a flange 132 on the valve body 60 to the end of the armature 32. The dimension "B" is measured on the power group, which is the distance from the end face 82 of the inlet tube 16 to the lower side face 125 of an external groove 126 of the valve body shell 42.

The valve group 128A and power group 128B are each respectively placed in suitable fixturing 129A, 129B, aligned with each other. The armature 32 and valve body 60 are received into the valve body shell and relatively advanced to be telescoped together. The initially assembled position sets a valve lift greater than that to be set later.

FIG. 7 shows diagrammatically carrying out the initial assembly of the valve group 128A to the power group 128B. A split ring fixed holder 124 engages external groove 126 on the valve body shell 42 of the preassembled power group 128B.

A driver tool 134 engages flange 132 on the valve body 60 included in the preassembled valve group 128A, which includes all of the components except the O-ring 18 and nonmetallic shell cover 98.

The driver tool 134 pushes the valve group 128A into power group 128B by telescoping the valve body 60 into the valve body shell 42 until reaching a fixed stop 127. At this point, a large clearance, i.e., an average of 300 microns, exists between the end face 80 of the armature 32 and the end face 82 of the inlet tube 16.

At this time, the assembled injector 10 is transferred into a lift setting apparatus, as collectively indicated in FIGS. 8A–8G. Only the critical components of the injector 10 are shown in these Figures for the sake of clarity.

Figure 8A:
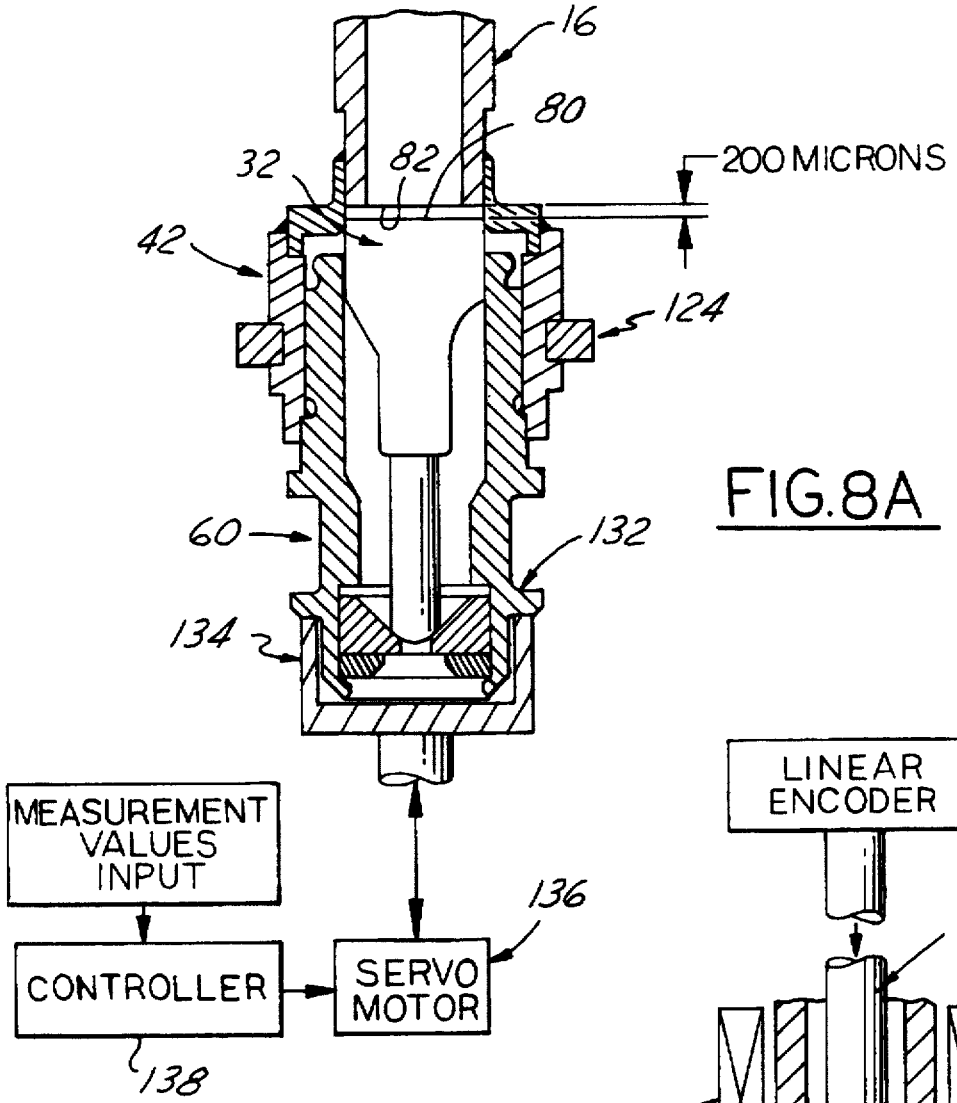
FIGS. 8A–8G are diagrammatic representations of the lift setting apparatus and method used to set the valve lift.

In FIG. 8A, a driver tool 134 engages the lower face of flange 132 of the valve body 60. The driver tool 134 is driven by a servo motor 136 (which may include a gear reducer) under the control of an industrial programmable controller 138. A split ring fixed seat 124 engages the external groove 126 in the valve body shell 42.

An initial movement of the driver tool 134 is executed so as to reduce the clearance between the inlet tube end face 82 and the armature end face 80 to 200 microns. This travel distance is set corresponding to the measurement values taken previously. The 200 micron gap is set to insure that the solenoid 44 will reliably lift the armature 32 into engagement with the inlet tube 16. FIG. 8A shows the actual gap greatly exaggerated for clarity.

Figure 8B:
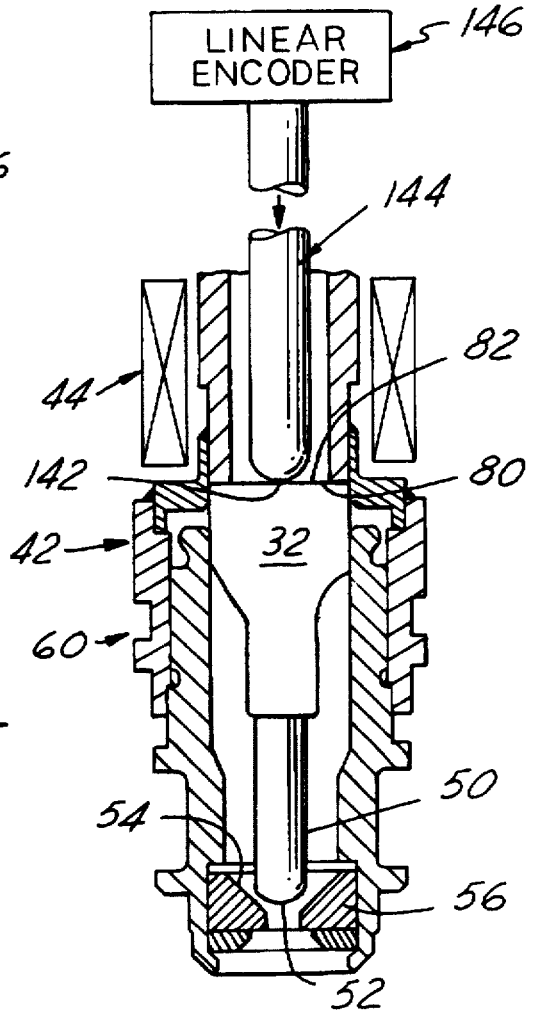

FIG. 8B depicts the first step in setting the valve lift. The solenoid 44 is energized, pulling the armature end face 80 into engagement with the inlet tube end face 82, lifting the tip 52 of the valve element 50 off the conical surface 54 of the valve seat 56.

The tip 142 of a linear encoder output rod 144 is driven by a linear encoder 146 to engage the armature 32 and measure its position when in abutment with the inlet tube end face 82. The linear encoder 146 may be of a commercially available type available from Heidenhein GmbH of Traunreut, Germany. The linear encoder 146 creates electronic signals corresponding to each position of the output rod 144 so as to be capable of obtaining electronic measurements between points contacted by the rod tip 142. The rod 144 is controllably driven by a constant force motor so as to have a constant contact force over a wide range. The initial reading is taken in the condition of FIG. 8B.

Figure 8C:
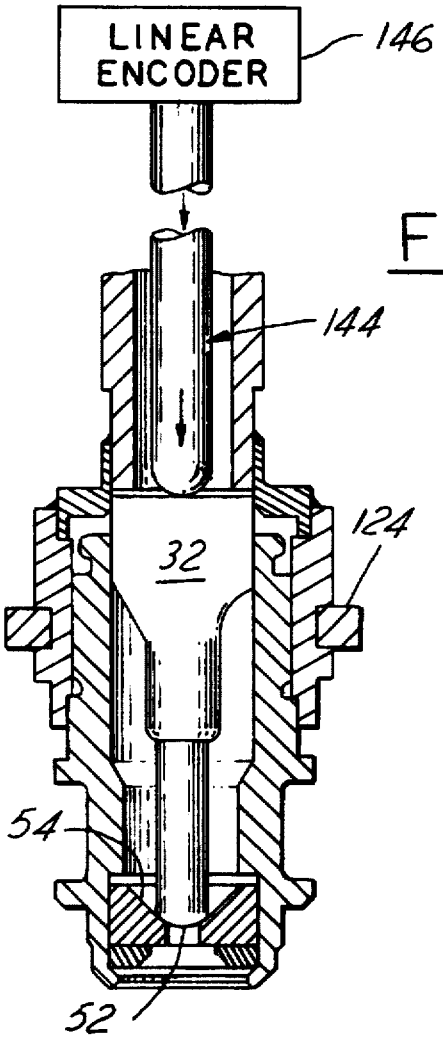

In FIG. 8C, the solenoid 44 is deactivated so that the output rod 144 drives the valve tip against the conical surface 54 of the valve seat 56. Another reading is taken at that point to determine the precise starting lift distance.

Figure 8D:
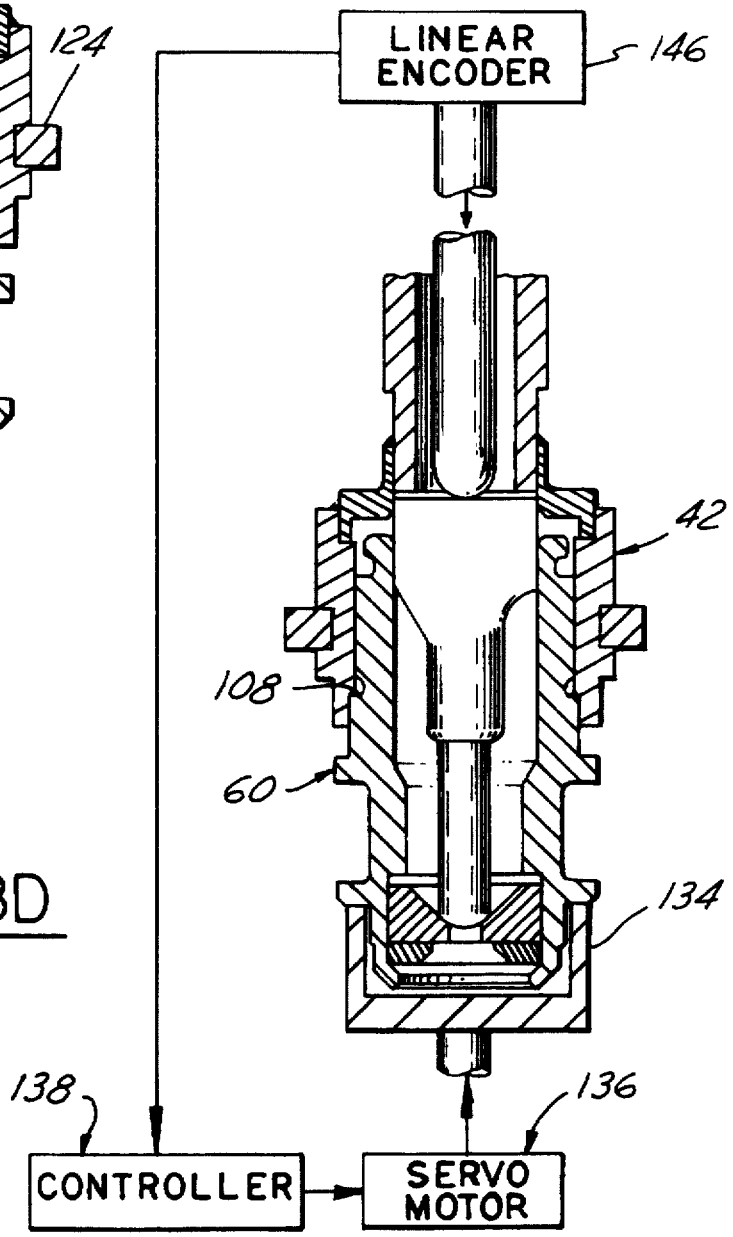

These readings are transmitted to the controller 138 which causes the servo motor 136 to drive the driver tool 134 to telescope the valve body 60 into the valve body shell 42, creating the interference bulge 108 to a position where there is a calculated gap just short of a desired final lift distance as indicated in FIG. 8D.

Figure 8E:
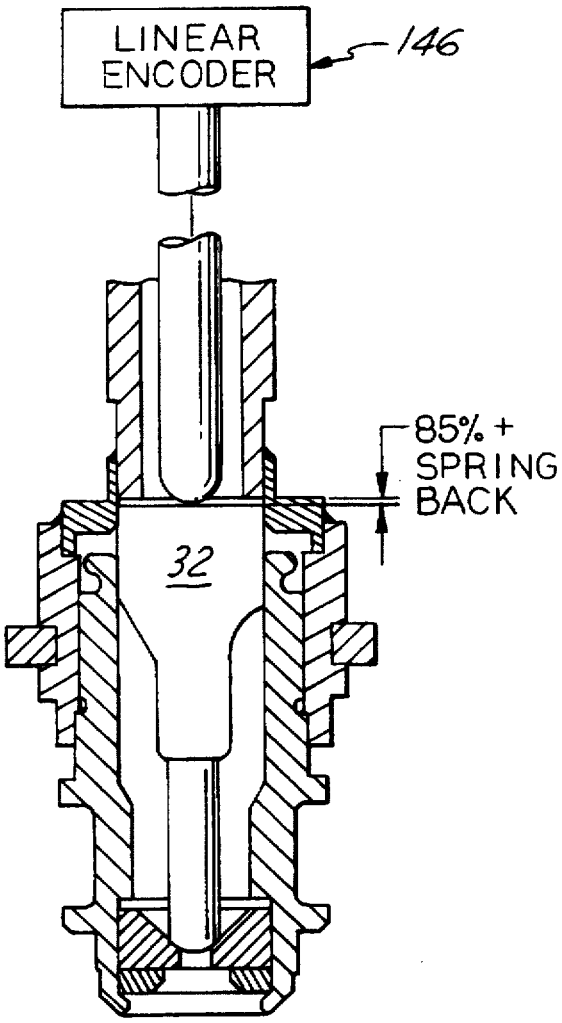

The driver tool 134 is released to allow the armature 32 to spring back, which spring back is measured by the linear encoder 146, as indicated in FIG. 8E.

Figure 8F:
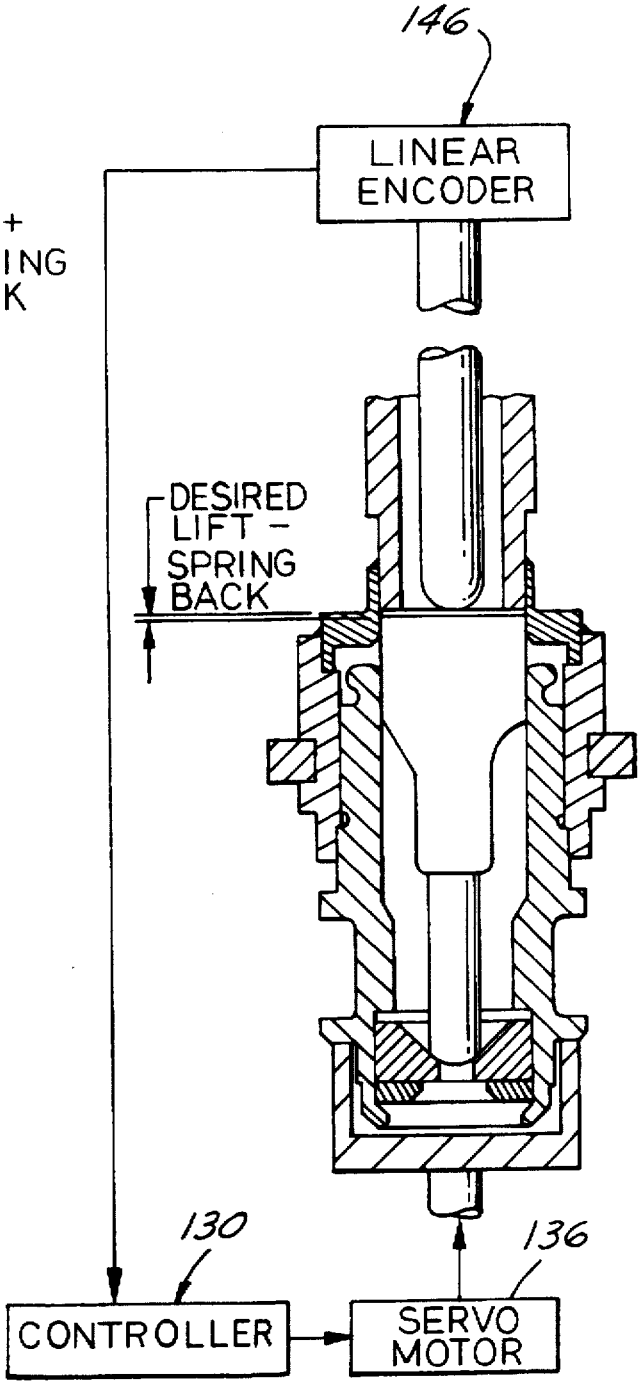

As indicated in FIG. 8F, the driver tool 134 is again driven by servo motor 136 into a position corresponding to the calculated lift position, taking into account the extent of spring back.

Figure 8G:
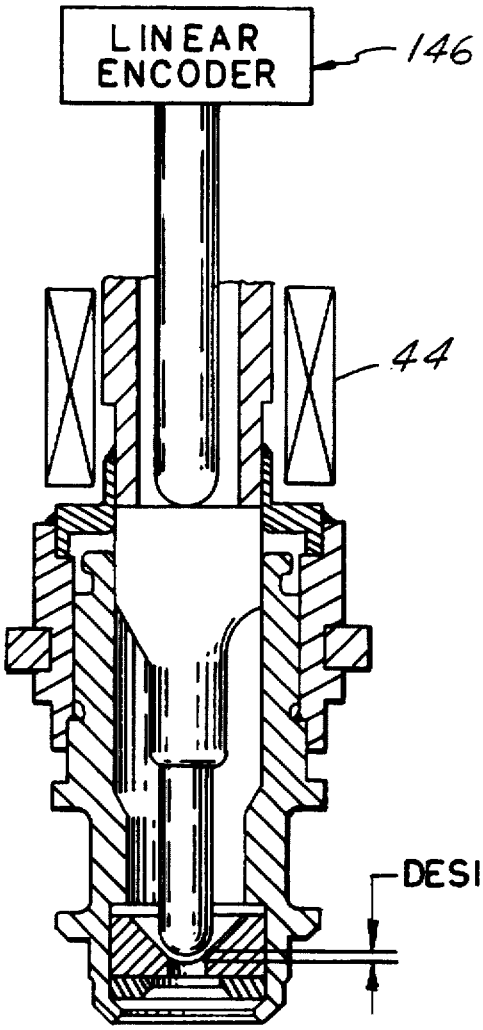

As a final step, as indicated in FIG. 8G, the solenoid 44 is again energized to measure, by means of the linear encoder 146, the actual lift obtained.

Figure 9:
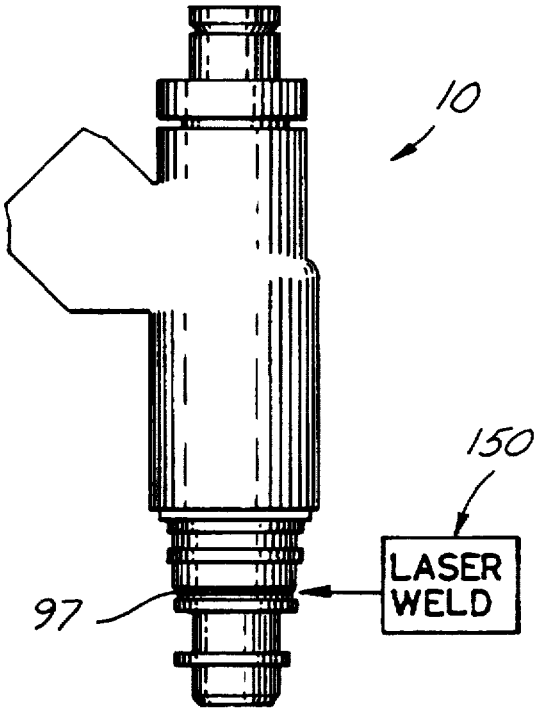
FIG. 9 is a diagrammatic view of the laser welding step used to fix the set valve lift.

As shown in FIG. 9, the injector 10, removed from the lift setting apparatus, the weld 122 is applied by a laser welder 150 as the injector 10 is rotated. Preferably, the laser beam is directed at 90° to the exterior of the weld skirt 97, which weld direction has been found to aid in reducing the effects of weld shrink on valve lift by minimizing the axial dimension of the weld bead.

What is claimed is:

1. A method of setting a desired valve lift in a fuel injector for internal combustion engines, the fuel injector having a needle valve armature assembly slidable in a bore in a valve body member, a valve seat fastened in an end of the valve body member and engaged by a tip of the needle valve, the armature having an end face movable into abutment against an end face of a pole piece of a solenoid operator upon energization of the solenoid operator, the movement of the armature carrying the needle valve tip off the valve seat and defining the valve lift, the method comprising the steps of:

fitting a valve body shell member over the valve body member so as to allow telescoping movement therebetween;

fixing said valve body shell member relative to the pole piece;

telescoping the valve body member into the valve body shell member and measuring their relative position to determine when a set position corresponding to the desired valve lift is reached; and then interferingly fitting portions of said members so as to cause displacement of material from one member as said members are telescoped together to create a mechanical interlock therebetween.

2. The method according to claim 1 further including the step of welding said valve body shell member to the valve body member after said set position is established.

3. The method according to claim 1 including the initial step of preassembling a valve group including injector components mounted to the valve body and a power group including injector components mounted to said valve body shell prior to telescoping together the valve body and said valve body shell.

4. The method according to claim 2 wherein the valve body member and said valve body shell member have portions press fit together to stabilize said members in said set position while said welding step is carried out.

5. The method according to claim 2 further including a step of reducing the thickness of said valve body shell adjacent to said weld by forming a groove in a weld skirt to allow weld shrinkage to pull portions of said valve body shell weld skirt radially inward.

6. The method according to claim 2 wherein in said step of welding, a fillet weld is formed between an end face of said valve body shell and a perimeter of the valve body member.

7. The method according to claim 2 wherein in said step of welding said valve body shell to the valve body member includes the step of directing a laser beam along a direction extending 90° to a longitudinal axis of said members.

8. The method according to claim 1 including the step of forming one of said members of a lower yield strength than the other member, and forming said other member with a groove located so that material of said one member is displaced into said groove to create said mechanical interlock.

9. The method according to claim 2 further including the step of fixing said valve shell member to said pole piece by attaching a valve body shell extension member to an end of said valve body shell member opposite said valve seat.

10. The method according to claim 9 further including the step of piloting a bore in said valve body shell extension member onto said pole piece and also piloting an end of the armature having said end face thereon in said valve body shell extension bore so as to maintain squareness of the armature end face and the pole piece end piece.

11. The method according to claim 10 further including the step of welding said valve body shell extension members to the pole piece member and to said valve body shell member.

12. The method according to claim 11 wherein said step of welding said valve body shell extension member to the pole piece and said valve body shell member comprise the steps of forming hermetic welds to establish fluid containment within said valve body shell and extension members.

13. The method according to claim 2 wherein in said welding step a hermetic weld is formed.

14. The method according to claim 9 including the step of constructing said extension member of nonmagnetic material.

15. A method of setting valve lift in a fuel injector for an engine of the type having an elongated valve element attached to an armature, the valve element having a tip moved off and on a valve seat to open or close the fuel injector to start or stop fuel flow, a solenoid operator when energized causing the armature to move so as to cause the valve element to move off the valve seat and against a fixed stop, the movement constituting the desired valve lift, the method comprising the steps of:

telescoping two members together in a manner so that the relative position of the members establishes the desired valve lift, and measuring their relative position until a position corresponding to said desired valve lift is reached;

creating a localized section of an interference fit between said members adjacent a groove in one of said members and causing displacement of material from one of said members into said groove as said members are telescoped together so as to create a mechanical interlock between said members; and then welding said members together to permanently fix the relative telescoped position and the correspondingly determined valve lift.

16. A fuel injector adapted to be mounted in a seat in a fuel rail, comprising:

an injector housing;

a solenoid operator coil in said housing;

an inlet tube having a pole piece portion lying within said solenoid coil, said inlet tube having an inner bore for receiving fuel flow from the fuel rail, said pole piece portion having an end face defining a fixed stop;

an armature-valve element assembly including an armature having an end face adapted to be lifted against said pole piece end face when said solenoid coil is energized, and also including an attached elongated valve element;

a valve body having a valve seat member fixedly mounted at one end of said valve body aligned with a bore extending through said valve body, said armature-valve element assembly slidably received in said bore;

said valve seat having an opening, when open allowing fuel flow out of said valve body bore;

said valve element having a tip urged into engagement with said valve seat by a compression spring mounted to engage said armature, said tip closing flow of fuel when engaged with said valve seat, said solenoid coil when energized pulling said valve tip out of engagement with said valve seat when said armature is drawn against said pole piece portion end face to allow outflow of fuel from said bore in said valve body;

a valve body shell telescoped over said valve body with diameter portions interferingly fit together with material displaced from one of said diameter portions by telescoping movement of said valve body shell and valve body forming an interlock between said valve body shell and said valve body;

said valve body shell fixed relative to said pole piece at an upper end adjacent said pole piece and also to said valve body, whereby the relative telescoped position of said valve body and valve body shell set the desired valve lift.

17. The fuel injector according to claim 16 further including a nonmagnetic valve body shell extension attached to said upper end of said valve body shell and also to said pole piece.

18. The fuel injector according to claim 16 wherein said valve body shell and valve body are welded to be fixed together.

19. The fuel injector according to claim 16 wherein said valve body and valve body shell include portions press fitted together to remain in adjusted telescoped positions relative each other.

20. The fuel injector according to claim 16 further including a clearance groove in one of said valve body and valve body shell located adjacent said interferingly fit portions to receive said displaced material.

21. The fuel injector according to claim 20 wherein one of said valve body or valve body shell has a lower yield strength whereby displaced caused by relative telescoping of said members is moved into said clearance groove.

22. The fuel injector according to claim 17 wherein said extension has an upper bore received over said pole piece extension to be piloted thereon.

23. The fuel injector according to claim 22 wherein said extension upper bore also receives one end of said armature.

24. The fuel injector according to claim 22 wherein said extension is hermetically welded to said pole piece and said valve body shell, and said valve body shell is hermetically welded to said valve body to provide fluid containment.

* * * * *